United States Patent [19]

Cox

[11] Patent Number: 5,065,781

[45] Date of Patent: Nov. 19, 1991

[54] STORAGE TANK CLEANOUT APPARATUS

[76] Inventor: Ernest J. Cox, P.O. Box 714, Chico, Tex. 76030

[21] Appl. No.: 497,855

[22] Filed: Mar. 22, 1990

[51] Int. Cl.[5] ..... B08B 9/08

[52] U.S. Cl. ..... 137/15; 137/590; 73/863.86; 15/1.7; 15/246.5; 134/22.11; 134/59; 134/113

[58] Field of Search ..... 137/590, 15; 15/246.5, 15/1.7, 415.1; 134/22.1, 22.11, 59, 113; 73/863.86

[56] References Cited

U.S. PATENT DOCUMENTS

| | | | |
|---|---|---|---|
| 2,332,940 | 10/1943 | Senke | 15/1.7 |
| 2,845,091 | 7/1958 | Neer | 15/246.5 X |
| 3,268,933 | 8/1966 | Marantette et al. | 15/1.7 |
| 3,341,880 | 9/1967 | Young | 15/246.5 X |
| 3,797,664 | 3/1974 | Pentz et al. | 210/83 |
| 3,807,560 | 4/1974 | Pentz et al. | 210/83 |
| 3,858,573 | 1/1975 | Ryan et al. | 73/863.86 X |
| 3,997,444 | 12/1976 | McGivern | 210/242 R |
| 4,022,066 | 5/1977 | Kaune | 73/863.86 |
| 4,457,332 | 7/1984 | Hoshino et al. | 137/590 X |
| 4,721,127 | 1/1988 | Conlin | 15/246.5 X |
| 4,834,138 | 5/1989 | Dellasso | 137/590 |

*Primary Examiner*—John Rivell

*Attorney, Agent, or Firm*—Kenneth C. Hill

[57] ABSTRACT

An apparatus for removing denser materials from the bottom of an oil storage tank provides an extended bottom hose with multiple openings which lies on the bottom of the tank. The bottom hose is attached to a riser through which liquid is removed from the tank. The bottom hose and riser assembly can be partially assembled prior to lowering it into the tank, with assembly completed after the bottom hose has been lowered through an opening and is completely within the storage tank. The extended bottom hose removes denser materials from a larger area on the floor of the tank than is possible from a single opening. A sample tube is provided attached to the riser just outside the storage tank to allow sampling of the liquid being pumped from the tank. The cleanout process can be shut off when good oil begins to be pumped out of the tank.

16 Claims, 4 Drawing Sheets

STORAGE TANK CLEANOUT APPARATUS

BACKGROUND OF THE INVENTION

1. Field of the Invention

The present invention relates generally to oil field equipment, and more specifically to an apparatus suitable for use in removing dense liquids and sediment from the bottom of an oil storage tank.

2. Description of the Prior Art:

Oil which is removed from land based wells is often pumped into tanks for temporary storage. The oil is removed periodically from the storage tanks for transport to a central location by tank trucks. Depending on the flow rate of the well or wells connected to the storage tank, oil can remain in the storage tank for as long as two to three weeks.

Because of various sediments suspended in the recovered oil, and denser liquids mixed with the oil, settling occurs in the storage tanks. The heavier liquids and sediments settle to the bottom of the tank, where they tend to form discrete layers graded by density. Typically, salt water and paraffin form two fairly discrete layers underneath the oil.

The settled denser liquids, such as salt water and paraffin, are pumped out of the storage tank at intervals. Removal of this unwanted sludge at the bottom of the storage tank allows more oil to be stored into the tank, decreasing the frequency with which the storage tank must be emptied. Also, when the oil is eventually removed, its overall quality is better when these impurities have been removed beforehand.

FIG. 1 illustrates a technique currently used to perform oil storage tank cleanout. A storage tank 10 is shown partially filled with oil 12. A sludge containing paraffin 14 underlines the oil 12. The top of the storage tank 16 contains a small opening 18, commonly referred to as a thief hatch, which allows access to the interior of the tank 10 A loading valve 20 positioned about 12 inches from the bottom of the tank 10, allows oil to be removed from the tank 10 when it is full.

From time to time the paraffin 14 is removed from the tank 10. This may be done on a regular basis, with the frequency of removal being determined by the pumping rates of the attached well or wells (not shown) and the known composition of the oil stored in the tank 10. Alternatively, a periodic check can be made of the paraffin level within the tank 10. A common technique for performing the check involves sampling the fluid on the tank bottom using a device known as a thief (not shown) which is dropped through the thief hatch 18. Another technique uses a metal tape (not shown) coated with a chemical which changes color in the presence of water. Dropping such a tape through the thief hatch 18 allows an estimate to be made of the amount of paraffin residing in the tank 10. Whatever technique is used, when the paraffin level becomes too deep, a service call can be made and a worker dispatched to clean out the storage tank 10.

Cleanout of the storage tank 10 is performed by lowering a riser hose 22 through the thief hatch 18. Its lower end has a fitting 24 which prevents the opening of the riser hose 22 from becoming blocked by the floor of the storage tank 10. A pump hose 26 is connected to the riser 22, and connects to a fluid pump attached to a tank truck (not shown).

Sludge is removed from the bottom of the storage tank 10, a process commonly referred to as "pulling the bottom" of the tank. This process involves having a worker attach the pump hose 26 to the riser 22, and lower the riser through the thief hatch 18. The worker then returns to the tank truck and starts the pump which begins pumping fluid from the bottom of the tank 10. After some period of time which seems appropriate to the worker, a sample is taken of the liquid currently being pumped from the tank lo. If good oil shows, a sufficient amount of paraffin is assumed to have been removed from the tank, and the hoses can be removed. This is accomplished by ascending to the top of the storage tank and pulling the riser hose 22 out through the thief hatch 18 while the pump is operating. This causes the liquid currently in the riser hose 22 and pump hose 26 to be cleared and emptied into the tank truck, allowing the hoses to be more easily stored on the tank truck for transport to another location.

The pumps used on the tank trucks for this operation transfer liquid at a typical rate of approximately three barrels per minute. It will be appreciated that, due to the delay in removing the riser 22 from the tank 10, several barrels of good oil will be pumped out of the tank. Additionally, several barrels of good oil are often pumped into the tank truck before a sample is taken to determine that enough paraffin has been pumped out of the tank. This results in good oil being wasted, and increases disposal fees because an excess volume of liquid is removed from the tank each time it is cleaned out.

In addition to pumping out excess amounts of good oil, FIG. 1 illustrates another problem with the technique described above. Salt water layers on the bottom of the tank tend to be removed almost completely, inasmuch as the salt water has a relatively low viscosity and a hole does not tend to form in such layer. However, the paraffin 14 has a relatively high viscosity and a hole will tend to be formed in the paraffin lay ®r 14 in the immediate neighborhood of the riser hose 22 as shown. This means that good oil can be pumped out of the tank while there is still a significant amount of paraffin remaining in it. This often causes the worker to complete the cleanout operation while there is a significant amount of paraffin remaining in the tank. Once the paraffin layer settles down, a later sampling may still show an excess depth of paraffin. This means that the cleanout must be repeated.

Thus, in general, the prior art technique for pulling the bottom of an oil storage tank removes too much good oil and results in too much paraffin remaining behind. This results in increased production costs due to the repeat trips which must be made to clean out the storage tank and to the loss of good oil. Additional costs are incurred if a production hauler comes to empty the tank, and refuses the oil because of too much paraffin contain therein. Also, refusal of a tank can necessitate shutting down the associated wells if the tank is full. All of these problems add to the cost and decrease the profits to be made from the well.

It would be desirable to provide an apparatus and method for removing denser liquids from the bottom of an oil storage tank which maximizes the amount of paraffin and other liquids removed and minimizes the amount of good oil removed.

SUMMARY OF THE INVENTION

It is therefore an object of the present invention to provide an apparatus and method for removing denser materials from the bottom of a storage tank.

It is a further object of the present invention to provide such an apparatus and method which minimizes the amount of good oil removed from the storage tank.

It is another object of the present invention to provide such an apparatus and method which maximizes the amount of denser materials removed from the storage tank.

It is yet another object of the present invention to provide such an apparatus and method which can be used as a simple replacement for current techniques, allowing existing equipment and personnel to utilize the improved apparatus and method.

Therefore, according to the present invention, an apparatus for removing denser materials from the bottom of an oil storage tank provides an extended bottom hose with multiple openings which lies on the bottom of the tank. The bottom hose is attached to a riser through which liquid is removed from the tank. The bottom hose and riser assembly can be partially assembled prior to lowering it into the tank, with assembly completed after the bottom hose has been lowered through an opening and is completely within the storage tank. The extended bottom hose removes denser materials from a larger area on the floor of the tank than is possible from a single opening. A sample tube is provided attached to the riser just outside the storage tank to allow sampling of the liquid being pumped from the tank. The cleanout process can be shut off when good oil begins to be pumped out of the tank.

BRIEF DESCRIPTION OF THE DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

DESCRIPTION OF THE PREFERRED EMBODIMENT

Figure 2:
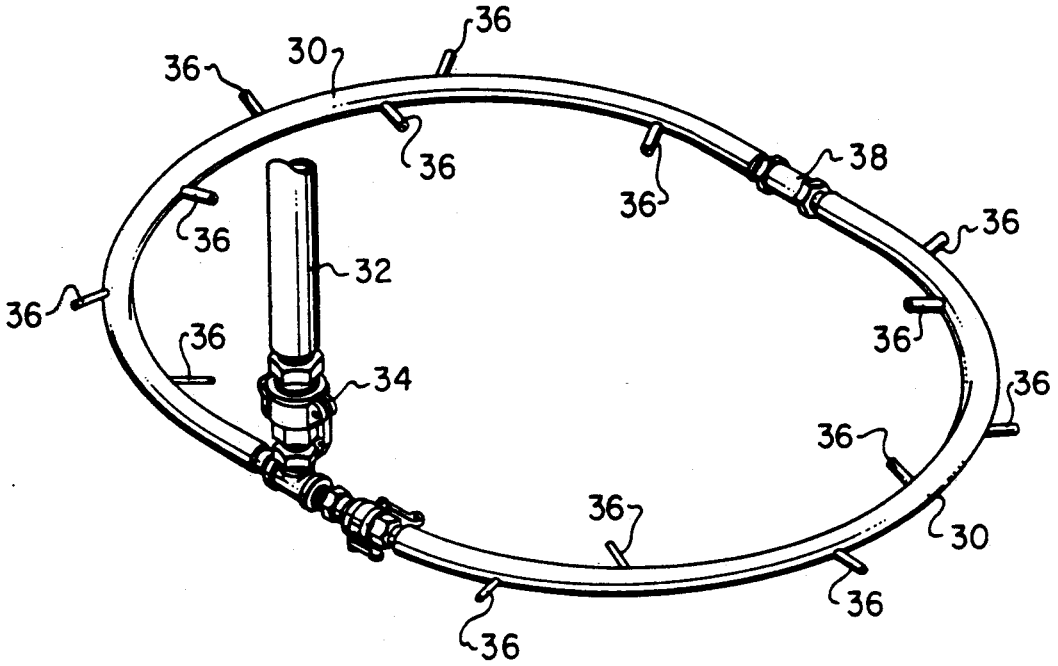
FIG. 2 is a perspective view of a bottom hose and its attachment to a riser according to the present invention.

FIG. 2 shows a bottom hose for use with a preferred embodiment of the present invention. A bottom hose 30 is connected to a riser 32 through a coupling 34. In a preferred embodiment, the riser 32 is a standard 2 inch hose such as typically used in the oil field business. The bottom hose 30 is preferably a 1 inch inside diameter reinforced rubber, or similar material, hose. The bottom hose 30 has a plurality of projecting tubes 36 which are spaced around the hose in a manner which will be described in more detail in connection with FIG. 4. These tubes provide openings into the interior of bottom hose 30, and allow liquids to be transported thereinto.

A weight 38 is attached to the bottom hose 30 opposite the coupling 34, and acts to cause bottom hose to lie flat on the bottom of the storage tank. The weight 38 can be solid, so that liquids taken into the bottom tube 30 on either side of the weight 38 are forced to flow in opposite directions through the bottom hose 30 toward the coupling 34 and into the riser 32. Since the bottom hose 30 covers a relatively large area of the bottom of the storage tank, paraffin can be removed from the tank much more evenly.

Figure 1:
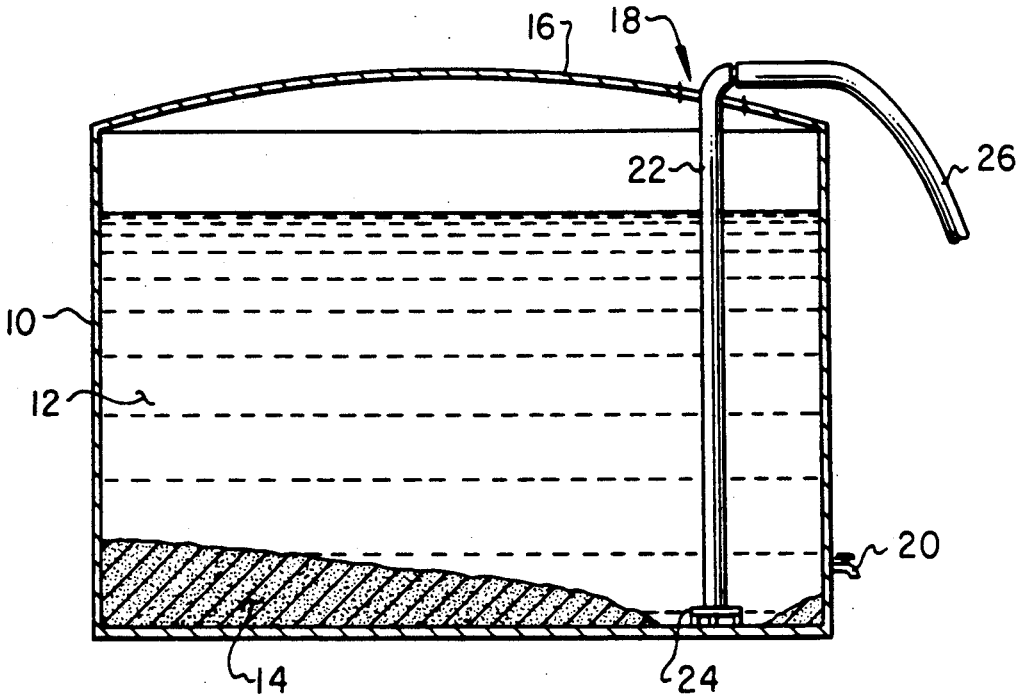
Fig. 1 prior art
FIG. 1 is a cut away elevation of an oil storage tank being cleaned out according to a prior art technique.
Figure 3:
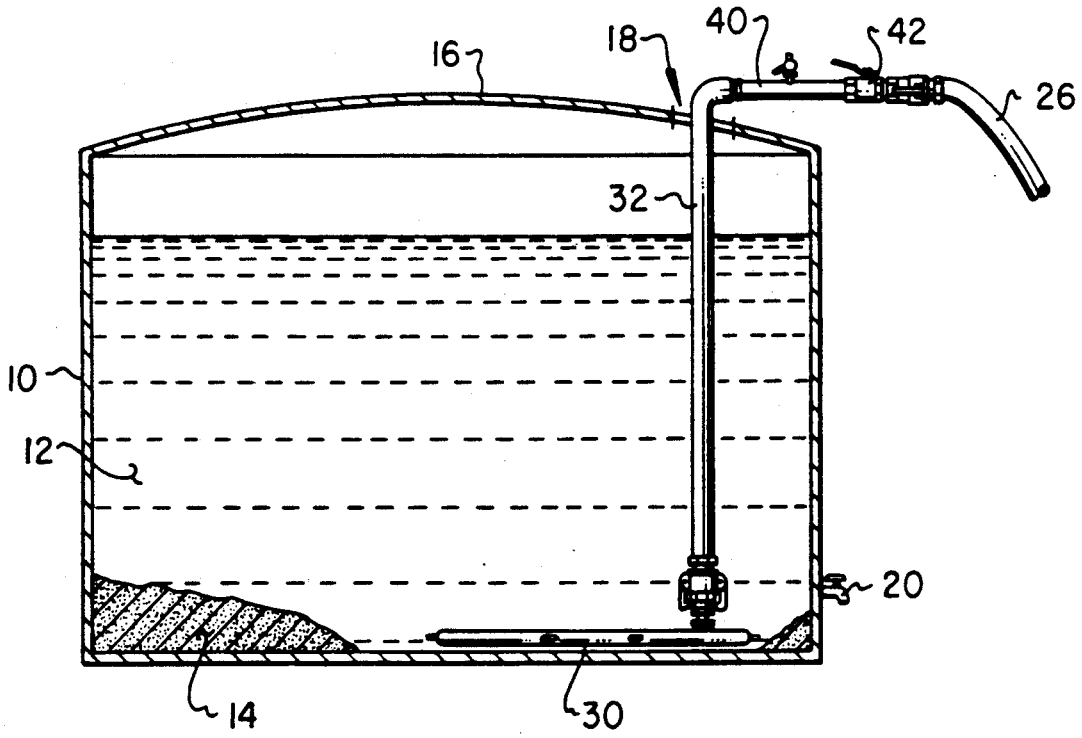
FIG. 3 is a cut away elevation of a storage tank being cleaned out according to a preferred embodiment of the present invention.

The use of the bottom hose 30 to clean out a storage tank is illustrated in FIG. 3. Since the paraffin 14 is being removed through multiple openings spaced over a larger area, the hole which is formed due to the high viscosity of the paraffin is much larger than was the case described in the illustration of FIG. 1. This allows much more of the paraffin to be removed from the tank 10 before good oil begins to be pumped out of the storage tank.

FIG. 3 also illustrates the use of a sample tube 40 attached to the riser 32 just after it comes out of the tank 10. The sample tube 40 allows the composition of the liquid being removed from the tank to be determined so that the cleanout operation can be halted as soon as good oil begins to be pumped out of the tank. A main valve 42 is provided as part of the sample tube 40 to allow fluid flow through the riser 32 and pump hose 26 to be shut off as soon as desired.

Figure 4:
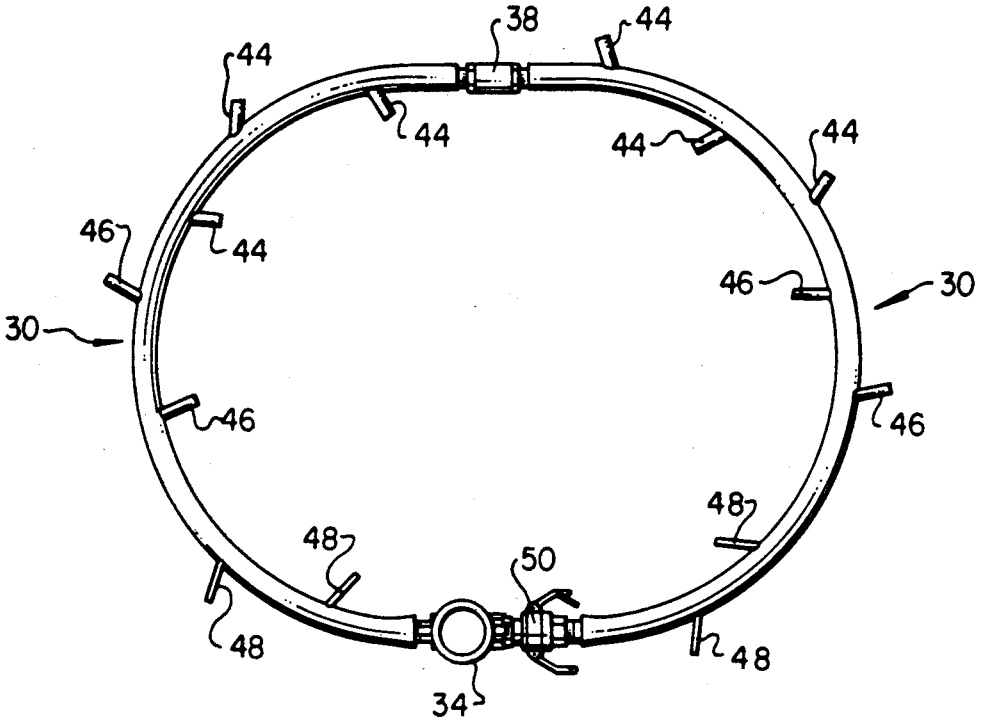
FIG. 4 is a diagrammatic top view of a preferred embodiment for the bottom hose.

FIG. 4 illustrates the construction of the bottom hose 30 in more detail. As described above, the bottom hose 30 is preferably made of a reinforced flexible material having a 1 inch internal diameter. The projecting tubes 44 closest to the weight 38 have a diameter of approximately ¾ inch, and a length of approximately 1 inch. The projecting tubes 44 are angled in their connection with the bottom hose 30 as shown so that fluid flowing into the projecting tubes 44 turns through an angle of less than 90 degrees upon entering the bottom tube 30. The projecting tubes 44 are preferably made from a corrosion resistant metal such as brass.

Projecting tubes 46, located approximately midway between the weight 38 and the riser hose coupling 34, have a diameter of approixmately ½ inch, are slightly longer than the projecting tube 44, and make an angle of approximately 90 degrees with the bottom hose 30.

The projecting tubes 48 closest to the riser coupling 34 have a diameter of approximately 174 inch, are longer than projecting tubes 46, and are angled so that fluid entering the bottom hose 30 through them turns through an angle of greater than 90 degrees. Projecting tubes 46 and 48 are also made from a corrosion resistant metal.

The purposes of the various lengths, diameters, and angles of connection of the various projecting tubes 44, 46, and 48 is to even out the fluid flow through the bottom tube 30. Due to the high viscosity of the paraffin pumped through the bottom tube 30, there is a significant pressure drop along the bottom tube 30 between the point immediately below the riser coupling 34 and the location of the weight 38. Providing openings as described above causes approximately equal amounts of the viscous paraffin to flow into the interior of the bottom hose 30. This causes paraffin to be removed at an approximately even rate for the entire length of the bottom hose.

The spacing of the projecting tubes 44, 46, and 48 is also preferably adjusted to compensate for the viscosity of the paraffin. The projecting tubes are more closely spaced along the bottom hose 30 near the weight 38, and spaced further apart near the coupling 34 to the riser. This assists in evening out the flow rate as described above.

A coupling 50 is provided in the bottom hose 30 to allow one end of it to be disconnected near the riser hose coupling 34. This allows the bottom hose 30 to be easily lowered into the storage tank through the small thief hatch 18, which would not be possible if the stiff bottom hose 30 where permanently connected into the circular pattern shown in FIG. 4. The thief hatch 18 typically has a diameter of 8 inches, which is not large enough to allow the bottom hose 30 to pass while connected into the circular shape.

Figure 5:
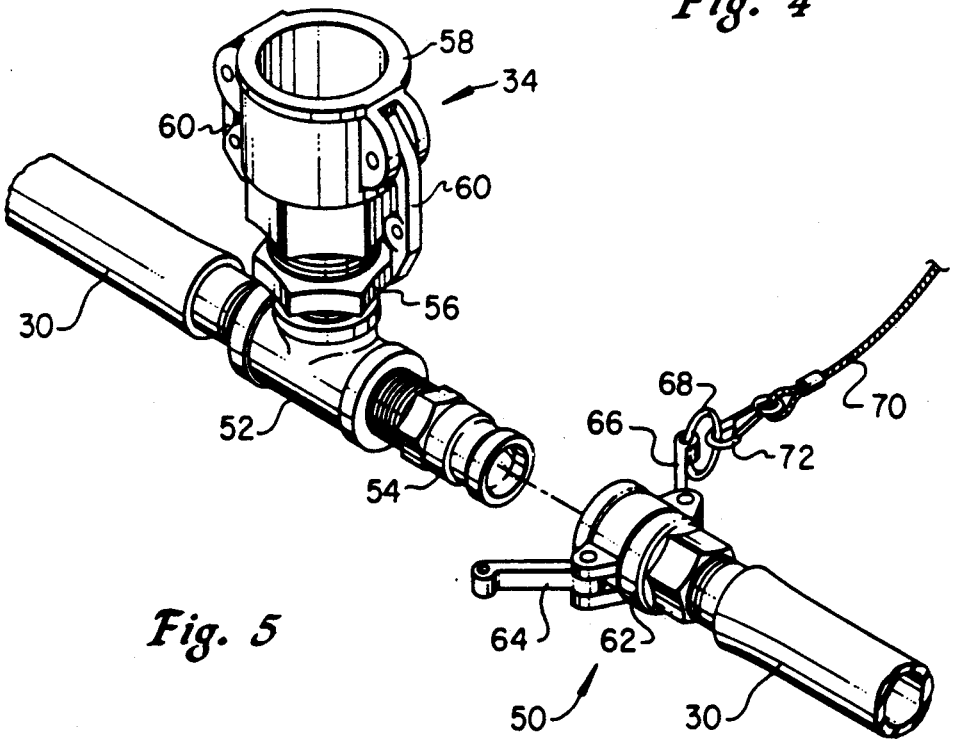
FIG. 5 is a perspective view of coupling mechanisms used with the preferred embodiment of the bottom hose.

Details of the riser hose coupling 34 and bottom hose coupling 50 are shown in FIG. 5. One end of the bottom hose 30 is permanently connected to a brass T-connecter 52. The other horizontal opening of the T-connecter 52 is connected to a male portion of a quick release coupling 54. The vertical portion of the T-connecter 52 is connected to a 1 inch-to-2 inch adapter 56, which is in turn connected to a 2 inch female quick release coupling 58. As known in the art, the female quick release coupling 58 has two locking levers 60 which allows a matching male quick release coupling attached to the riser hose (not shown) to be firmly coupled therewith, but to be easily removed when desired.

A 1 inch female quick release coupling 62 is connected to the other end of bottom hose 30, and is designed to be connected to the male quick release coupling 54. Female coupling 62 has two locking levers 64, 66 to allow it to be firmly attached to the male coupling 54, and easily removed when desired. A metal ring 68 attached to locking lever 66 allows a rope 70 to be connect thereto by a snap connecter 72. When the bottom hose 30 is lowered into the storage tank, the rope 70 is attached to the female coupling 62, and the end of the bottom hose 30 containing the female coupling 62 is lowered into the tank first. Once the entire bottom hose 30 has been lowered into the tank, so that the T-connecter 52 is inside of the tank, the rope 70 can be pulled to recover the female coupling 62 and allow it to be attached to the male coupling 54. This completes the assembly of the bottom hose 30, and allows it to operate as described above.

Figure 6:
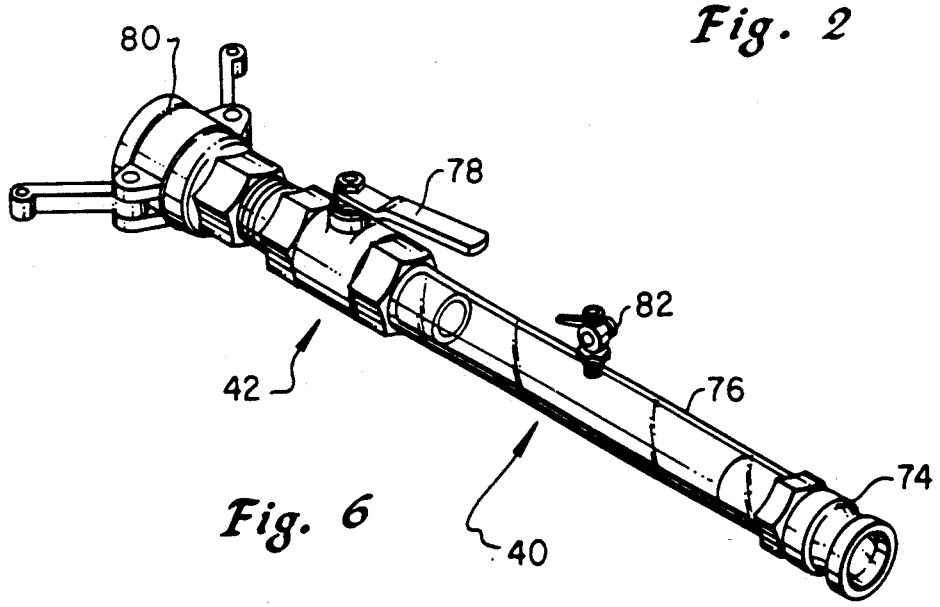
FIG. 6 is a perspective view of a preferred sample tube.

FIG. 6 illustrates a preferred sample tube 40 and main valve 42 for use as illustrated in FIG. 3. A male quick release coupling 74 is intended for connection to a corresponding female quick release coupling on the top end of the riser tube (not shown). The male coupling 74 is connected to a solid tube 76. Tube 76 is preferably made of a clear or translucent plastic material which allows visual observation of the fluid flowing through it. The opposite end of the tube 76 is connected to the main valve 42, which is controlled by a control lever 78. Manipulation of the control lever 78 causes valve 42 to be opened and closed, thereby allowing or blocking flow of fluid through the tube 76. A female quick release coupling so allows the sample tube 40 to be connected to a corresponding male coupling of the pump hose 26.

A small sample valve 82 is provided on the tube 76 to allow a small amount of fluid to be released therefrom for sampling by the worker. If desired, the sample valve 82 can be located at some other position of the sample tube 40, and need not actually be attached to some portion of the clear tube 76. When the system is in operation, the worker can observe the flow of fluid through the tube 76, and take a small sample of the fluid through sample valve 82 when visual appearance indicates that good oil is now being pumped out. Preferably, the main valve 42 is closed prior to the sample valve 82 being opened. This allows oil to flow out of the sample valve 82 rather than causing air to be sucked into the sample tube 40 due the action of the pump.

Figure 7:
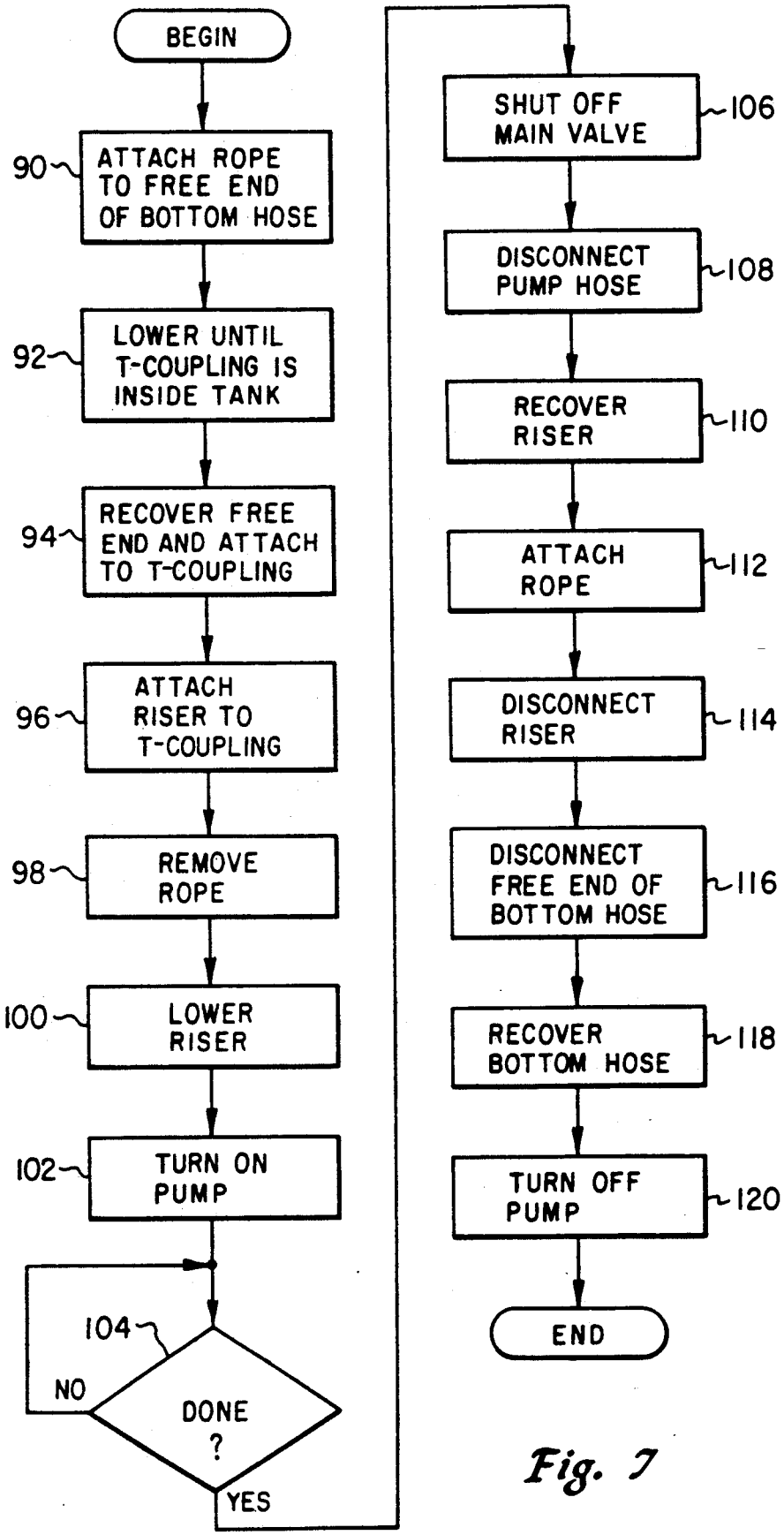
FIG. 7 is a flow chart illustrating a preferred method for using the apparatus of the preferred embodiment.

FIG. 7 is a flowchart illustrating a preferred method for utilizing the apparatus described above. After the apparatus has been carried to the top of the storage tank, the rope is attached to the free end of the bottom hose 90. The bottom hose is then lowered until the T-coupling is inside the storage tank 92. The free end of the bottom hose is then recovered by pulling on the rope, and is attached to the T-coupling to complete assembly of the bottom hose 94. The riser is then attached to the riser coupling 96, and the rope removed 98.

At this point, the bottom hose is fully assembled into its approximately circular shape, and it is inside of the storage tank. The riser and the bottom hose are then lowered to the bottom of the tank 100, and the worker returns to the tank truck and turns on the pump 102. If two or more people are working together, this step (102) can be performed by another. As described herein, the preferred apparatus and method are easily usable by a single worker.

The worker then returns to the top of the tank, and observes the liquid flowing through the sample tube 40. So long as the cleanout operation is not complete 104, the worker simply waits. Once the cleanout operation is complete, as evidenced by the fact that good oil has begun flowing through the sample tube 40, the main valve is shut off 106 and the pump hose is disconnected 108. At this time, the pump on the tank truck continues running, and acts to clear the pump hose. The pump hose can be simply dropped to the ground at this stage.

The riser and bottom hose are recovered 110 by pulling on the riser until the T-coupling is immediately below the thief hatch. The rope is then attached to the bottom hose 112, and the riser hose disconnected 114. The free end of the bottom hose is then disconnected by manipulating the bottom hose quick release coupling 110. The bottom hose is now linear and can be recovered through the thief hatch 118. The worker then returns to ground level and shuts off the pump at the tank truck 120.

The apparatus and method described above allow for improved cleanout of oil storage tanks. When a cleanout operation is performed, a greater percentage of the viscous paraffin is removed. This is accomplished while removing very little of the good oil. The apparatus can be used by a single worker, and no special skills are required beyond the already acquired skill of determining the difference between good oil and paraffin. The cost for the improved apparatus is very low, and its use results in a significant cost savings.

The apparatus described above can be modified for permanent installation if desired. If installation in an existing storage tank is required, the apparatus described above can be used. The riser is permanently attached in position, and the worker attaches the sample tube to perform the clean out. The connection to the riser can be made on top of the tank, or the riser may extend partway down the side. In the latter case, it is preferred to install a valve which is permanently attached to the riser so that a siphoning effect can be prevented.

A bottom hose can also be permanently installed in a new tank when it is built. Such installation preferably uses a metal bottom hose, which can be substantially circular or have another shape which covers a large portion of the tank bottom. Such a permanent installation also preferably uses a riser which is attached to a valve located in the side of the tank, simplifying the job of the worker when a clean out is to be performed.

The length of the bottom hose can be varied as desired to suit the size of the storage tank. The hole size and spacing can also be varied from that described and retain the advantages of the invention.

While the invention has been particularly shown and described with reference to a preferred embodiment, it will be understood by those skilled in the art that various changes in form and detail may be made therein without departing from the spirit and scope of the invention.

I claim:

1. Apparatus for removing material from the bottom of an oil storage tank, comprising:

a riser hose for transporting fluid from the bottom of the storage tank to a location external to the tank, said riser hose oriented approximately vertically and entering the tank through a top thereof; and a bottom hose adapted for connected to said riser hose, said bottom hose having a plurality of spaced openings for allowing the entry of the material to be removed, said bottom hose further being formed into an approximately circular shape wherein said bottom hose has an end detachably connected to allow said bottom hose to be straightened out, wherein the end can be reconnected so as to form the approximately circular shape after said bottom hose has been lowered into the storage tank;

wherein material drawn into said bottom hose as a result of suction applied by a pump is drawn out of the storage tank through said riser hose.

2. The apparatus of claim 1, further comprising:

a line connected to the detachable end of the bottom hose, wherein the detachable end can be brought into proximity with the location of the connection by manipulating said line.

3. The apparatus of claim 1, wherein said riser hose is connected to a coupling which is in turn connected to a T-connecter, and wherein said bottom hose has one end permanently connected to the T-connector and another end detachably connected to the T-connector.

4. The apparatus of claim 3, wherein the coupling is a quick release coupling.

5. The apparatus of claim 3, wherein said bottom hose is detachably connected to the T-connecter with a quick release coupling.

6. The apparatus of claim 1, further comprising:

a sampling device connected to said riser tube for sampling the composition of the material removed from the storage tank, said sampling device including a valve for shutting off flow of fluid through said riser hose.

7. The apparatus of claim 6, wherein said sampling device contains a clear portion for visually observing fluid flowing therethrough.

8. The apparatus of claim 7, wherein said sampling device further includes a sampling valve for allowing a small amount of fluid to be removed from said sampling device.

9. Apparatus for removing material from the bottom of an oil storage tank, comprising:

a riser hose for transporting fluid from the bottom of the storage tank to a location external to the tank; and a bottom hose adapted for connection to said riser hose, said bottom hose having a plurality of spaced openings for allowing the entry of the material to be removed, wherein the spaced openings have decreasing sizes closer to the connection to said riser hose, and wherein the spaced openings are spaced further apart at locations closer to the connection to said riser hose; said bottom hose further being formed into an approximately circular shape;

wherein material drawn into said bottom hose as a result of suction applied by a pump is drawn out of the storage tank through said riser hose.

10. The apparatus of claim 8, wherein the spaced openings have projecting tubes connected thereto.

11. A method for removing material from the bottom of a storage tank, comprising the steps of:

lowering a bottom hose having a plurality of openings into the tank;

connecting the bottom hose into an approximately circular shape while it is inside the tank;

attaching a riser hose to the bottom hose and lowering the bottom hose to the bottom of the tank;

pumping material out of the tank through the bottom hose and the riser hose;

when said material pumping step is completed, raising the riser hose out of the tank and disconnecting the riser hose from the bottom hose;

disconnecting the bottom hose from its approximately circular shape; and raising the bottom hose out of the tank.

12. The method of claim 11, wherein said connecting step is performed after the riser hose has been attached and before the bottom hose is lowered to the bottom of the tank.

13. The method of claim 12, wherein said step of disconnecting the bottom hose from its circular shape is performed before the riser hose is disconnected from the bottom hose.

14. The method of claim 11, wherein said step of disconnecting the bottom hose from its circular shape is performed before the riser hose is disconnected from the bottom hose.

15. The method of claim 11, further comprising the steps of:

during said pumping step, determining the composition of the material being pumped out of the tank; and completing said pumping step when the composition of the material being pumped out of the tank changes in a predetermined manner.

16. The method of claim 15, wherein said determining step is performed by sampling the fluid being pumped out of the tank using a sampling device, and wherein said pumping step is completed by closing a valve connected to the sampling device.

* * * * *